United States Patent [19]

Mahabadi et al.

[11] Patent Number: 4,877,706

[45] Date of Patent: Oct. 31, 1989

[54] SINGLE COMPONENT COLD PRESSURE FIXABLE ENCAPSULATED TONER COMPOSITIONS

[75] Inventors: Hadi K. Mahabadi; Tie H. Ng, both of Mississauga; Nancy A. Listigovers, Oakville; Trevor I. Martin, Burlington, all of Canada

[73] Assignee: Xerox Corporation, Stamford, Conn.

[21] Appl. No.: 198,265

[22] Filed: May 25, 1988

[51] Int. Cl.[4] ..... G03G 9/08

[52] U.S. Cl. ..... 430/106.6; 430/98; 430/110; 430/138; 428/407

[58] Field of Search ..... 430/138, 106.6, 98, 430/110; 428/407

[56] References Cited

U.S. PATENT DOCUMENTS

| | | | |
|---|---|---|---|
| 3,900,669 | 8/1975 | Kiritani | 428/307 |
| 4,280,833 | 7/1981 | Beestman et al. | 71/100 |
| 4,329,415 | 5/1982 | Ikeda et al. | 430/111 |
| 4,417,916 | 11/1983 | Beestman et al. | 71/93 |
| 4,465,755 | 8/1984 | Kiritani et al. | 430/138 |
| 4,476,211 | 10/1984 | Hosoi | 430/137 |
| 4,520,091 | 5/1985 | Kakimi et al. | 430/110 |
| 4,599,271 | 7/1986 | Chao | 428/402.21 |
| 4,636,451 | 1/1987 | Matkin et al. | 430/98 X |
| 4,708,924 | 11/1987 | Nagai et al. | 430/98 X |
| 4,725,522 | 2/1988 | Breton et al. | 430/138 |
| 4,727,011 | 2/1988 | Mahabadi et al. | 428/407 |
| 4,766,051 | 8/1988 | Breton et al. | 430/138 |
| 4,784,930 | 11/1988 | Hatakeyma | 430/138 |

FOREIGN PATENT DOCUMENTS

| | | | |
|---|---|---|---|
| 58-100857 | 6/1983 | Japan | 430/138 |
| 61-56352 | 3/1986 | Japan | 430/138 |
| 61-56358 | 3/1986 | Japan | 430/138 |
| 2097947 | 11/1982 | United Kingdom | 430/98 |
| 2107890 | 5/1983 | United Kingdom | 430/98 |
| 2107892 | 5/1983 | United Kingdom | 430/98 |

*Primary Examiner*—Paul R. Michl
*Assistant Examiner*—Jeffrey A. Lindeman
*Attorney, Agent, or Firm*—E. O. Palazzo

[57] ABSTRACT

A cold pressure fixing toner composition comprised of a core containing a polymer component and magnetic pigment particles, and wherein the core is encapsulated within a shell comprised of the interfacial polycondensation reaction of a first polyisocyanate component and a second amine component, which toner includes thereon an electroconductive material obtained from a water based dispersion of said material in a polymeric binder, said first polyisocyanate component being selected from the group consisting of PAPI 27, PAPI 135, PAPI 94, PAPI 901, Isonate 143L, Isonate 181, Isonate 125M, Isonate 191, and Isonate 240; and said second amine component selected from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)triamine, tris(2-aminoethyl)amine, 4,4'-methylene bis(cyclohexylamine), bis(3-aminopropyl)ethylene diamine, 1,3-bis(aminomethyl)-cyclohexane, 1,5-diamino-2-methylpentane piperazine, 2-methylpiperazine, 2,5-dimethylpiperazine, and 1,4-bis(3-aminopropyl)piperazine.

41 Claims, No Drawings

SINGLE COMPONENT COLD PRESSURE FIXABLE ENCAPSULATED TONER COMPOSITIONS

BACKGROUND OF THE INVENTION

This invention is generally directed to improved cold pressure fixable toner compositions, and more specifically the present invention is directed to magnetic single component development, pressure fixable, encapsulated toners containing, for example, a core component inclusive of magnetite and thereover a durable polymeric shell prepared by interfacial polymerization. In one embodiment there is provided in accordance with the present invention an improved encapsulated cold pressure fixable toner composition wherein the shell is comprised of the reaction product of a first isocyanate component selected, for example, from the group consisting of polymethylene polyphenyl isocyanates (PAPI) and diphenylmethane diisocyanates (Isonate), and a second amine component as illustrated in more detail hereinafter. In another embodiment of the present invention, the toner compositions obtained include thereon an electroconductive material thereby enabling compositions with a controlled, and stable resistivity such as, for example, from about $1\times10^3$ to about $1\times10^8$, and preferably from about $5\times10^4$ and $1\times10^7$ ohm-cm, which toners are particularly useful for inductive development processes. The aforementioned toner composition possesses a number of advantages including the ability to provide a substantially higher final image fix to plain paper in some instances; a shell with substantially improved mechanical properties; and moreover, the shell monomers selected possess low vapor pressures, thus reducing environment hazards, which is not the situation with some of the prior art toner shells. Moreover, the shell capsules employed in the prior art often do not withstand shear forces or impact during use as toners, a disadvantage alleviated with the encapsulated toner compositions of the present invention. Thus, for example, with the toner compositions of the present invention, the shell does not rupture prematurely causing the adhesive core component comprised, for example, of a polymer and magnetite to become exposed, which upon contact with other toner particles or ionographic subsystem component surfaces forms undesirable agglomerates. The toner compositions of the present invention are useful for permitting the development of images in electrophotographic imaging systems including electrostatic imaging systems with electroreceptor wherein pressure fixing, especially fixing in the absence of heat is selected.

Cold pressure fixing processes are known. These processes have a number of advantages in comparison to heat fixing, primarily relating to the requirements for less energy, since the toner compositions used can be fused at room temperature. Nevertheless, many of the prior art cold pressure fixable toner compositions, particularly those prepared by conventional melt blending processes, suffer from a number of deficiencies. For example, these toner compositions must usually be fused under very high pressures to achieve acceptable image fix to plain paper. Also, with some of the prior art processes, substantial image spreading can result from the high pressures required. Additionally, the cold pressure fixing toner compositions of the prior art have other disadvantges in that, for example, these compositions when used for development cause in some instances images with high gloss that are of low crease resistance. Furthermore, the use of high fixing pressures results in images with a waxy feel, and crushed paper fibers referred to as paper calendering. In contrast, images developed with the cold pressure compositions of the present invention possess a low gloss appearance on plain paper, and furthermore, these images in most instances possess a substantially improved image fix level at relatively low fixing pressures with significantly improved resistance to removal or flaking when creased. Also, the toner compositions prepared in accordance with the process of the present invention have durable shells thus enabling images with substantially no background deposits. Also, with the toner compositions of the present invention, particularly with respect to their selection for single component inductive development processes, the toner particles contain a complete uniform and substantially permanently attached electroconductive material thereby imparting stable electroconductive surface charge to the particles inclusive of situations wherein these particles are subjected to vigorous agitation, a disadvantage associated with many prior art toner compositions wherein, for example, electroconductive dry surface additives such as carbon black are selected. Further, with the aforementioned prior art toner compositions there is usually obtained images of low quality with substantial background deposits, particularly after a number of imaging cycles especially subsequent to vigorous mechanical agitation which causes toner electroconductivity instability most likely since the additives such as carbon black are not permanently retained on the surface of the toner particles.

There are disclosed in U.S. Pat. No. 4,307,169 microcapsular electrostatic marking particles containing a pressure fixable core, and an encapsulating substance comprised of a pressure rupturable shell, which shell is formed by an interfacial polymerization. One shell prepared in accordance with the teachings of this patent is a polyamide obtained by interfacial polymerization. In the '169 patent, it is indicated that when magnetite or carbon black is selected they must be treated in a separate process to prevent migration thereof to the oil phase.

Interfacial polymerization processes are described in British Patent Publication No. 1,371,179, the disclosure of which is totally incorporated herein by reference, which publication illustrates a method of microencapsulation based on in situ interfacial condensation polymerization. More specifically, this publication discloses a process which permits the encapsulation of organic pesticides by the hydrolysis of polymethylene polyphenylisocyanate, or toluene diisocyanate monomers. Also, the wall forming reaction disclosed in the aforementioned publication is initiated by heating the mixture to an elevated temperature at which point the isocyanate monomers are hydrolyzed at the interface to form amines, which in turn react with unhydrolyzed isocyanate monomers to enable the formation of a polyurea microcapsule wall.

Moreover, there is disclosed in U.S. Pat. No. 4,407,922, the disclosure of which is totally incorporated herein by reference, interfacial polymerization processes for pressure sensitive toner compositions comprised of a blend of two immiscible polymers selected from the group consisting of certain polymers as a hard component, and polyoctadecylvinylether-comaleic anhydride as a soft component.

Additionally, illustrated in a copending application U.S. Ser. No. 621,307, entitled Single Component Cold Pressure Fixable Encapsulated Toner Composition, the disclosure of which is totally incorporated herein by reference, are single component development cold pressure fixable toner compositions, wherein the shell selected can be prepared by an interfacial polymerization process. A similar teaching is present in copending application U.S. Ser. No. 718,676, the disclosure of which is totally incorporated herein by reference, directed to single component magnetic cold pressure fixable toner compositions. In the aforementioned application, the core can be comprised of magnetite and a polyisobutylene of a specific molecular weight encapsulated in a polymeric shell material generated by an interfacial polymerization process. More specifically, there are illustrated in the aforementioned copending application cold pressure fixable magnetic single component developers with carbon black and large amounts of magnetite.

Furthermore, other prior art, primarily of background interest, includes U.S. Pat. Nos. 4,254,201; 4,465,755; and Japanese Patent Publication No. 58-100857. The Japanese publication discloses a capsule toner with high mechanical strength, which is comprised of a core material including a display recording material, a binder, and an outer shell, which outer shell is preferably comprised of a polyurea resin. In the '091 patent, there are disclosed encapsulated electrostatographic toners wherein the shell material comprises at least one resin selected from polyurethane resins, a polyurea resin, or a polyamide resin. In addition, the '755 patent discloses a pressure fixable toner comprising encapsulated particles containing a curing agent, and wherein the shell is comprised of a polyurethane, a polyurea, or a polythiourethane. Moreover, in the '201 patent there are illustrated pressure sensitive adhesive toners comprised of clustered encapsulated porous particles, which toners are prepared by spray drying an aqueous dispersion of the granules containing an encapsulated material.

Furthermore, there are illustrated in U.S. Pat. No. 4,280,833 encapsulated materials prepared by interfacial polymerization in aqueous herbicidal compositions containing these capsules. More specifically, as indicated in column 4, beginning at line 9, there is disclosed a process for encapsulating the water immiscible material within the shell of the polyurea, a water immiscible organic phase which consists of a water immiscible material, that is the material to be encapsulated, and polymethyl polyphenyl isocyanate is added to the aqueous phase with agitation to form a dispersion of small droplets of the water immiscible phase within the aqueous phase; and thereafter, a polyfunctional amine is added with continuous agitation to the organic aqueous dispersion, reference column 4, lines 15 to 27. Also, of interest is the disclosure in column 5, line 50, wherein the amine selected can be diethylene triamine, and the core material can be any liquid, oil, meltable solid or solvent soluble material, reference column 4, line 30. A similar teaching is present in U.S. Pat. No. 4,417,916.

In U.S. Pat. No. 4,599,271 there are illustrated microcapsules obtained by mixing organic materials in water emulsions at reaction parameters that permit the emulsified organic droplets of each emulsion to collide with one another, reference the disclosure in column 4, lines 5 to 35. Examples of polymeric shells are illustrated, for example, in column 5, beginning at line 40, and include isocyanate compounds such as toluene diisocyanate, and polymethylene polyphenyl isocyanates. Further, in column 6, at line 54, it is indicated that the microcapsules disclosed are not limited to use on carbonless copying systems; rather, the film material could comprise other components including xerographic toners, see column 6, line 54.

Other prior art of interest includes U.S. Pat. No. 4,520,091, which illustrates an encapsulated toner material wherein the shell can be formed by reacting a compound having an isocyanate with a polyamide; reference column 4, lines 30 to 61, and column 5, line 19; and U.S. Pat. No. 3,900,669 illustrating a pressure sensitive recording sheet comprising a microcapsule with polyurea walls, and wherein polymethylene polyphenyl isocyanate can be reacted with a polyamide to produce the shell, see column 4, line 34.

Additionally, in U.S. Pat. No. 4,476,211 there is disclosed a process for the preparation of toner compositions which can be selected for cold pressure fixing processes, which compositions are provided with a colored electroconductive powder on the outer surface thereof, such powders including, for example, carbon black and colloidal graphite, which are spray dried together with the wet toner dispersion. Also, U.S. Pat. No. 3,196,032 and Dutch Patent Application No. 7203523 illustrate a process of rendering single component developer powders electroconductive by the deposition of fine carbon particles on the toner surfaces. Disadvantages associated with the aforementioned toners include the release of the carbon black particles from the surface resulting in a loss of conductivity stability, and also resulting in contamination and premature failure of the electrical systems of the electrophotographic imaging apparatus within which they are incorporated. Moreover, British Pat. No. 940,577 and U.S. Pat. No. 4,286,037 illustrate the use of water soluble and water insoluble antistatic agents as electroconductive coating materials, however, high impractical loadings such as, for example, 8 to 35 percent by weight of ammonium salts are needed to obtain a resistivity of $10^7$ to $10^{11}$ ohm-cm, which adversely effects the particle size; flow and fusing properties of the toner particles, and has other disadvantages.

Although many of the aforementioned encapsulated toners are suitable for their intended purposes, there remains a need for single component development cold pressure fixable toner compositions that exhibit significantly improved image fix and crease resistance properties when applied to plain paper and fixed at relatively low fixing pressures. Additionally, there is a need for single component encapsulated toner compositions with durable shells that do not rupture prematurely resulting in undesirable toner agglomerations. There is also a need for single component encapsulated toner compositions that are of lower cost in comparison to similar prior art toner compositions. There is also a need for single component development encapsulated toner compositions which exhibit stable conductivity when subjected to agitation in developer subsystems.

SUMMARY OF THE INVENTION

It is an object of the present invention to provide single component development toner compositions with many of the advantages illustrated herein.

Another object of the present invention resides in the provision of encapsulated single component development toner compositions with a high image fix to paper at relatively low pressures.

In another object of the present invention there are provided single component development cold pressure fixable toner compositions capable of being fixed at relatively low fixing pressures, and wherein the shells thereof are durable and do not rupture prematurely.

In yet another object of the present invention there is provided an encapsulated toner composition capable of generating low gloss images subsequent to fixing.

Moreover, in another object of the present invention there are provided electroconductive single component encapsulated toner compositions and processes for the preparation thereof, which toners possess stable conductivity values especially when subjected to vigorous mechanical agitation.

In another object of the present invention there are provided single component development cold pressure fixable toner compositions that are synthesized in some instances from materials that are less hazardous from an environmental standpoint.

These and other objects of the present invention are accomplished by the provision of single component pressure fixable toner compositions wherein a core component is encapsulated by certain polymeric shells, especially those comprised of polymers obtained from isocyanate substituted aromatic compounds. More specifically, in one embodiment of the present invention there are provided single component development cold pressure fixable toner compositions comprised of a polymeric core with magnetic pigment particles therein, such as magnetite, and an encapsulating polymeric shell prepared by interfacial polymerization. These encapsulated shells are obtained by the reaction of a first component comprised of polyisocyanates available from Dow Chemical Company, including for example PAPI 27, PAPI 135, PAPI 94, PAPI 901, Isonate 143L, Isonate 181, Isonate 125M, Isonate 191, and Isonate 240; and a second amine component selected, for example, from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)-triamine, tris(2-aminoethyl)amine, 4,4'-methylene bis(-cyclohexylamine), bis(3-aminopropyl)ethylene diamine, 1,3-bis(aminomethyl)cyclohexane, 1,5-diamino-2-methylpentane, piperazine, 2-methylpiperazine, 2,5-dimethylpiperazine, and 1,4-bis(3-aminopropyl)piperazine. Generally, the shell polymer comprises from about 6 to about 25 percent by weight of the total toner composition, and preferably comprises from about 12 percent by weight to about 18 percent by weight of the toner composition. During the aforementioned interfacial polymerization to form the shell, the temperature is maintained at from about 15° C. to about 55° C., and preferably from about 20° C. to about 30° C. Also, generally the reaction time is from about 1 minute to about 5 hours, and preferably for about 20 minutes to about 90 minutes. Other temperatures and times can be selected, and further polyisocyanates and amines not specifically illustrated may be selected provided the objectives of the present invention are achieved.

In another embodiment, the present invention is directed to a cold pressure fixing toner composition comprised of a core containing a polymer component and magnetic pigment particles, which core is encapsulated within a shell comprised of the interfacial polycondensation reaction of a first polyisocyanate component and a second amine component, and wherein said toner includes thereon an electroconductive material obtained from a water based dispersion of said material in a polymeric binder, said first polyisocyanate component being selected from the group consisting of PAPI 27, PAPI 135, PAPI 94, PAPI 901, Isonate 143L, Isonate 181, Isonate 125M, Isonate 191, and Isonate 240; and said second amine component selected from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis (hexamethylene) triamine tris (2-aminoethyl) amine, 4,4'-methylene bis (cyclohexylamine), bis (3-aminopropyl)ethylene diamine, 1,3-bis (aminomethyl) cyclohexane, 1,5-diamino-2-methylpentane; and piperazine, 2-methylpiperazine, 2,5-dimethylpiperazine, and 1,4-bis (3-aminopropyl) piperazine. Generally, the isocyanate is selected in an amount of about 5 percent by weight to about 20 percent by weight, and preferably in an amount of about 8 percent by weight to about 12 percent by weight. Moreover, the polyisocyanate can be comprised of a mixture containing compounds having at least two isocyanate groups with an average functionality of from about 2 to 4, and preferably from about 2.0 to about 2.6, which mixtures contain, for example, from about 0.1 percent by weight to about 11.9 percent by weight of a first polyisocyanate containing an average functionality of 2.6, and from about 0.1 percent by weight to about 11.9 percent by weight of a second polyisocyanate containing a functionality of 2.0.

Other isocyanates, provided the objectives of the present invention are achieved, may perhaps be selected for reaction with the amine to enable formation of the shell by interfacial polymerization, reference for example U.S. Pat. No. 4,612,272 and U.K. Pat. Nos. 2,107,670 and 2,135,469, the disclosures of which are totally incorporated herein by reference.

Specific illustrative examples of known available isocyanates that can be selected include (1) polymethylene polyphenyl isocyanates (Dow Chemical Company); PAPI 27, PAPI 135, PAPI 94, PAPI 901; (2) diphenylmethane diisocyanates (Dow Chemical Company); Isonate 143L, Isonate 181, Isonate 125M, Isonate 191, Isonate 240; and (3) toluene diisocyanate and Desmodur RF (20 percent tris(p-isocyanato-phenyl)thiophosphate in methylene chloride; commercially available from Mobay Chemical Corp.) PAPI is believed to be a mixture of pure diphenylmethane diisocyanate (MDI) and higher molecular weight MDI oligomers. The weight average molecular weight is from about 260 to 300 for PAPI 94 and PAPI 901, and from about 340 to 380 for PAPI 27 and PAPI 135, while the average functionality is 2.3 for PAPI 94 and PAPI 901, and 2.6 for PAPI 27 and PAPI 135. Isonate 125M is pure MDI which is crystalline at room temperature. The other aforementioned isonates are liquid at room temperature, containing a mixture of pure MDI and its adducts.

Specific illustrative examples of water soluble amine compounds, which are capable of polymerizing interfacially with the above-mentioned isocyanate compounds to form a durable capsule shell, include:

(1) polyamines—ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)triamine, tris(2-aminoethyl)amine, 4,4'-methylene bis(cyclohexylamine), bis(3-aminopropyl)ethylene diamine, 1,3-bis(aminomethyl)cyclohexane, 1,5-diamino-2-methylpentane;

(2) piperazines—piperazine, 2-methylpiperazine, 2,5-dimethylpiperazine, 1,4-bis(3-aminopropyl)piperazine; and the like.

As a preferred shell material, there is selected the interfacial polycondensation product of Isonate 143L and 1,4-bis(3-aminopropyl)piperazine in the molar ratios of from about 1:1 to 1:1.2, and preferably from about 1:1.03 to 1:1.1; and PAPI 94 and 1,4-bis(3-aminopropyl)piperazine in the molar ratios of from about 1:1 to 1:1.3, and preferably from about 1:1.1 to 1:1.2.

Various core polymers in effective amounts can be selected for the toner compositions of the present invention. Generally, from about 10 percent by weight to about 64 percent by weight, and preferably from about 22 percent by weight to about 38 percent by weight of the core polymer based on the weight of the toner is selected, which polymer generally is a pressure fixable adhesive material possessing a low glass transition temperature of from about −170° C. to +25° C., and preferably from −80° C. to −10° C. The aforementioned core adhesive polymer is obtained by the in situ free-radical polymerization of a core monomer including acrylates and methacrylates, such as butyl acrylate, propyl acrylate, benzyl acrylate, pentyl acrylate, hexyl acrylate, cyclohexyl acrylate, dodecyl acrylate, ethoxy propyl acrylate, heptyl acrylate, isobutyl acrylate, methyl butyl acrylate, 2-ethoxyethyl acrylate, 2-butoxyethyl acrylate, 2-ethylbutyl acrylate, 2-ethylhexyl acrylate, 2-methoxypropyl acrylate, nonyl acrylate, octyl acrylate, m-tolyl acrylate, lauryl methacrylate, hexyl methacrylate, isodecyl methacrylate, 2-ethoxyethyl methacrylate, octyl methacrylate, decyl methacrylate, tetradecyl methacrylate, octadecyl methacrylate, dodecyl styrene, hexyl methyl styrene, nonyl styrene, tetradecyl styrene, or other known vinyl monomers, reference for example U.S. Pat. No. 4,298,672, the disclosure of which is totally incorporated herein by reference, mixtures thereof; and the like. In accordance with the present invention, the core monomer is polymerized to obtain a polymer with a number average molecular weight ($M_n$) of from about 15,000 to 100,000, and preferably from about 25,000 to 60,000; and a ratio ($M_w/M_n$) of weight average molecular weight/number average molecular weight of greater than 2, and preferably from about 2.5 to 4.0. When the aforementioned core adhesive is comprised of a vinyl polymer with an $M_n$ of greater than 100,000, the encapsulated toner may have poor fixability in some instances. Conversely, when the $M_n$ of the core polymer is less than 10,000, there results a toner that may cause defective print quality due to poor release from the dielectric receiver imaging member in the transfix step. The above monomers and polymers are readily available, and it is believed that the molecular weights thereof can be obtained by controlling the polymerization conditions thereof, including the concentration of monomer and free-radical initiators, polymerization temperature, and reaction time during the polymerization.

Illustrative examples of free-radical polymerization initiators selected for formation of the core polymer include azo compounds or mixtures thereof such as 2,2'-azobisisobutyronitrile (Vazo 64), 2,2'-azobis(2,4-dimethylvaleronitrile) (Vazo 52), and other similar known compounds, with the ratio of core monomer to initiator being from about 100/0.5 to about 100/6, and preferably from about 100/1 to 100/4, at a polymerization temperature and reaction time of from about 50° C. to 90° C. at about 2 hours to about 6 hours, respectively.

Illustrative examples of magnetic pigments present in the core of the toner compositions of the present invention include those well known in the art such as iron, cobalt, nickel, manganese, and alloys thereof; or compounds containing these elements such as magnetite, ferrite, and the like. Generally, the magnetic powder is present in an amount that enables it to function as a colorant and also provides the necessary magnetic properties to the toner for development, thus, generally from about 30 to 65 percent by weight of the total toner material is comprised of the magnetic pigment. Examples of specific commercially available magnetites that may be selected include Mapico Black, Pfizer MO-8029, Pfizer CX-6368, Bayer 8610, Columbian Chemicals magnetite, BASF magnetites, and other similar black iron oxides.

An illustrative process for the preparation of the encapsulated toner particles of the present invention is described in U.S. Pat. No. 4,727,011, the disclosure of which is totally incorporated herein by reference. This process involves dispersion of a magnetic colorant in a mixture of hydrophobic liquids such as a polyisocyanate, a core monomer and an initiator; subsequent dispersion of the above pigmented organic medium in an aqueous medium containing a hydrophilic protective colloid thereby generating a stable particle suspension; adding a water soluble shell component to produce shells around the core material particles; and heating of the reaction mixture to polymerize the core monomer. Subsequently, the encapsulated toner is washed with water in a filtration apparatus to remove unreacted water soluble shell component and protective colloid. The toner slurry is now suitable for the subsequent drying procedure.

According to one embodiment of the present invention, conductive encapsulated toner compositions can be prepared by spray drying the aforementioned slurry together with a conductive component such as carbon black or Aquadag E (Acheson Colloids Ltd.), a water based dispersion of conductive colloidal graphite or carbon black, and a polymeric binder. The resulting toner has a layer of conductive graphite or carbon black firmly bound to the surface. Comparison of the relative intensity of Auger nitrogen, carbon, and oxygen signals of graphite or carbon black treated toner when compared to untreated toner particles confirmed that the toner was uniformly and completely covered with graphite or carbon black. Thus, the spectrum of the untreated particle evidences a nitrogen signal characteristic of the polyurea shell structure, while the spectrum corresponding to the graphite or carbon black treated toner particles indicates that the nitrogen signal is absent, confirming that the polyurea shell is completely covered by graphite or carbon black.

The aforementioned binder for the graphite or carbon black may consist of a self-curing or a self-cross-linking grade, water soluble, water dilutable, or water reducible polymer resin, which upon drying becomes a water insoluble adherent coating. This polymeric binder can also be in the form of aqueous dispersions or emulsions. Examples of commercially available binders include acetate-ethylene emulsions (self-crosslinking grades E. I. duPont de Nemours & Company, Inc.), self-curing acrylic emulsions (Rohm and Haas Company), Acronal type polymer dispersions (self-crosslinking; BASF Wyandotte Corporation), styrene acrylic copolymers (self-crosslinking; National Starch and Chemical), carboxylated styrene butadienes (self-crosslinking; Unocal Chemicals), water-reducible alkyds (Spencer Kellogg Products), polyvinylpyrrolidone (General Aniline & Film Corporation), melamine-formaldehyde resin, urea-formaldehyde resin, phenol-formaldehyde resin, and other equivalent water-based polymer resins such as cellulose derivatives. Generally, the colloidal graphite or carbon black dispersion contains from about 1 to 5 percent by weight of binder, and from about 20 to 30 percent by weight of submicron graphite or carbon black with the remainder being water. Also, the conductive component such as the colloidal graphite dispersion is added to the aqueous toner slurry in an amount to provide from about 1.0 to 2.6 percent by weight graphite, or other conductive component based on the dry weight of toner. Thereafter, the resultant slurry is spray dried to enable toners with a resistivity of from about $1\times10^3$ to $1\times10^8$ ohm-cm, and preferably from about $5\times10^4$ to $1\times10^7$ ohm-cm.

The toner compositions of the present invention are particularly useful in the inductive development of electrostatic images. More specifically, in accordance with the present invention, there is provided a method for developing electrostatic images which comprises forming latent electrostatic images on a hard dielectric surface of an image cylinder by depositing ions from a corona source; developing the images with the single component magnetic toner composition illustrated herein; followed by simultaneous transferring and fixing by cold pressure onto paper with a toner transfer efficiency greater than 95 percent, and in many instances from 99 to 99.5 percent. The cold pressure fixing rollers selected generate pressures of from about 80 pounds per linear inch to about 250 pounds per linear inch, and preferably from about 100 pounds per linear inch to about 150 pounds per linear inch. Examples of cold pressure fixing processes and systems that can be selected include those available from Delphax, Hitachi and Cybernet.

Also, the present invention is directed to methods for the development of images by, for example, forming by ion deposition on an electroreceptor, such as a polymer impregnated anodized aluminum oxide, a latent image, developing this image with the cold pressure fixing encapsulated toner compositions of the present invention, and subsequently simultaneously transferring and fixing the image to a suitable substrate such as paper.

The following Examples are being submitted to further define various species of the present invention. These Examples are intended to be illustrative only and are not intended to limit the scope of the present invention. Also, in the Examples parts and percentages are by weight unless otherwise indicated.

The cold pressure fix printing machine selected for the testing of the toner compositions illustrated herein, including the following working Examples, was the Delphax S-6000 ionographic apparatus. The images developed were cold pressure fixed at either 200 or 100 pounds per linear inch.

Print quality was evaluated from a checkerboard print pattern. Fix level was measured from a standardized tape test in which a tape was pressed with a uniform reproducible standard pressure against an image and then removed. The fix level of the print was determined by measuring the reflected optical density (OD) after removal of the tape, and dividing this by the reflected OD of the original image. Conversion to percentage is accomplished by multiplying the aforesaid resulting value by 100. The percentage fix, therefore, is defined as the percentage of the original optical density remaining after the tape has been applied and subsequently removed. The initial and final fix levels represent the tape test of a print measured at 1 minute and after 24 hours, respectively. Toner shell integrity was judged qualitatively by observing any crushed or agglomerated toner on the hopper screen through which toner was fed to. the machine magnetic rollers. If crushed toner was found to adhere to and clog some of the screen openings after 2,000 copies, it was judged to have a premature toner rupture problem. The electrical resistivity was measured by applying 10 volts DC across a 1 cubic centimeter volume of toner and measuring the current. The electroconductivity activity of the toner was considered stable if the resistivity did not change by more than one decade under conditions equivalent to machine agitation for one hour. Particle size was measured using a 14 channel Coulter Counter (Model TA II, Coulter Electronics, Inc.).

EXAMPLE I

There was prepared an encapsulated single component development cold pressure fixable toner composition by adding to a two liter reaction vessel, followed by homogenization with a Brinkman Polytron (Model PT 45/80) at room temperature for 1 minute at 5,000 revolutions per minute (rpm) 121 grams of lauryl methacrylate (Rocryl 320, Rohm and Haas Co.), 53.6 grams of polymethylene polyphenylisocyanate with an isocyanate (NCO) content of 31.5 percent by weight (PAPI 27, The Dow Chemicals Co.), 4 grams of 2,2'-azobisisobutyronitrile initiator (Vazo 64, E. I. duPont de Nemours & Co., Inc.), and 4 grams of 2,2'-azobis(2,4-dimethylvaleronitrile) initiator (Vazo 52, E. I. duPont de Nemours & Co., Inc.). Into the mixture was dispersed 300 grams of magnetic iron oxide ($Fe_3O_4$, MO-8029 commercially available from Pfizer Pigments Inc.) with a Polytron at room temperature for 2 minutes at 10,000 rpm to obtain a homogeneous magnetic pigment dispersion.

Separately, an aqueous solution comprised of 0.6 gram of polyvinylalcohol (Vinol 523 commercially available from Air Products) in 1,200 grams of deionized water at 25° C. was prepared by stirring. The polyvinylalcohol solution was then charged into the above two liter reaction vessel. Thereafter, the above prepared magnetic pigment dispersion was dispersed into the aqueous phase for 3 minutes by means of the Polytron at 10,000 rpm. There was obtained an oil-in-water suspension containing pigmented oily spherical particles with an average particle diameter of 23 microns.

The resulting suspension was agitated under low speed stirring (about 300 rpm), and 21.4 grams of diethylenetriamine (99 percent grade, commercially available from Dow Chemical Company) in 50 grams of water was added to the reaction vessel to initiate the formation of the polyurea shell. Stirring at room temperature was continued for 90 minutes to permit completion of the polyurea formation by interfacial polymerization. Subsequently, to affect polymerization of the core monomer the temperature was gradually raised to and maintained at 85° C. for 5 hours at which time polymerization of the lauryl methacrylate was complete. After completion of core polymerization, the reaction vessel was cooled to 25° C. and any unreacted diethylenetriamine and residual polyvinylalcohol were removed from the slurry by elutriation. Subsequently, the toner slurry was sieved through a 60-mesh screen to remove coarse particles.

To the resulting slurry were added 200 grams of deionized water and 24 grams of Aquadag E (obtained from Acheson Colloids Ltd.), and containing about 22 percent by weight of graphite, and about 2 percent by weight of polymeric binder. This mixture was then subjected to spray drying with a Yamato DL-41 spray dryer at an air inlet temperature of 160° C., an air exit temperature of 65° C., and an atomizing pressure of 1.2 $kg/cm^2$ to obtain an encapsulated toner material comprised of a discrete magnetite pigmented polylauryl methacrylate core completely surrounded by a uniform polyurea shell, which shell contains permanently thereon the graphite electroconductive layer.

One hundred parts of the above-mentioned dry toner material was then blended with 0.5 parts of zinc stearate (release agent). The toner was then sieved through a 230-mesh screen to remove agglomerated additives, and tested in the Delphax S-6000 ionographic cold pressure fix printing device.

The tape test for image fix quality showed an initial fix level of about 30 percent, a final fix level of 64 percent, and an optical density of 1.5. There was no premature toner rupture problem.

The toner obtained evidenced a very stable and uniform electrical resistivity of $6\times10^5$ ohm-cm for 20,000 prints. Other properties for this encapsulated toner include a bulk density of 1.1 $gram/cm^3$ determined by known methods, magnetic saturation of 46.2 emu/gram determined by known methods, and $M_n$ and $M_w/M_n$ of the core polymer, poly(lauryl methacrylate), of 32,000 and 2.6, respectively, as determined by standard analytical methods.

With the toner compositions of the present invention, there can be included as external additives as illustrated in Example I, metal salts or metal salts of fatty acids such as zinc stearate and the like in an amount of from about 0.1 to about 3 percent by weight, reference for example U.S. Pat. Nos. 3,590,000, and 3,983,045, the disclosures of each of these patents being totally incorporated herein by reference.

EXAMPLE II

An encapsulated toner composition was prepared by repeating the procedure of Example I with the exception that no Aquadag E (colloidal graphite and binder) was used in the toner slurry composition for spray drying. This toner was then blended with 2.0 weight percent of carbon black (Vulcan XC-72R, Cabot) and 0.5 percent zinc stearate to provide a toner with a resistivity of $9\times10^5$ ohm-cm. When the resulting toner was tested in the printing machine of Example I, images with poor resolution and high background deposits were obtained after about 500 prints, an indication of unstable resistivity. After 2,000 prints, the resistivity of the toner in the development subsystem of the Delphax S-6000 was $1\times10^{11}$ ohm-cm.

EXAMPLES III AND IV

Two toner compositions were prepared to primarily illustrate the effects of shell composition on fixability and shell durability:

| | EXAMPLE III | EXAMPLE IV |
|---|---|---|
| Rocryl 320 (lauryl methacrylate) | 115.2 grams | 115.2 grams |
| Vazo 64 | 3.8 grams | 3.8 grams |
| Vazo 52 | 3.8 grams | 3.8 grams |
| Isonate 143L | 45.6 grams | 55.1 grams |
| Magnetic iron oxide (Pfizer MO-8029) | 300.0 grams | 300.0 grams |
| Dichloromethane | 20.0 milliliters | 20.0 milliliters |
| 1,4-bis(3-aminopropyl) piperazine | 32.0 grams | — |
| 1,6-Hexanediamine | — | 24.0 grams |
| Water | 80.0 milliliters | 80.0 milliliters |
| Polyvinylalcohol | 0.60 gram | 0.65 gram |
| Water | 1.0 liter | 1.0 liter |

These encapsulated toners were prepared by repeating the procedure of Example I with the exceptions that PAPI 27 was replaced with Isonate 143L; diethylenetriamine was replaced with 1,4-bis(3-aminopropyl)piperazine and 1,6-hexanediamine, respectively, for Examples III and IV. When tested in the S-6000 printing machine, the toners of Examples III and IV evidenced excellent shell durability. Example III containing 1,4-bis(3-aminopropyl)piperazine exhibited a much improved fixability with an initial fix level of 78 percent, and a final fix of 99 percent. For the toner of Example IV the initial fix level was 28 percent, and the final fix level was 89 percent.

As a comparison, Example VII with TDI-DRF-DETA shell composition provided a low initial fix level of 30 percent, and a final fix level of 68 percent, and in addition exhibited a severe premature toner rupture problem, see Table 1.

EXAMPLES V, VI AND VII

Three encapsulated toner compositions were prepared to illustrate primarily the toner structural integrity provided by the different shell compositions:

| | EXAMPLE V | EXAMPLE VI | EXAMPLE VII |
|---|---|---|---|
| Rocryl 320 (lauryl methacrylate) | 115.2 grams | 120.0 grams | 123.0 grams |
| Vazo 64 | 3.8 grams | 4.0 grams | 4.0 grams |
| Vazo 52 | 3.8 grams | 4.0 grams | 4.0 grams |
| PAPI 94 | 43.2 grams | 55.7 grams | — |
| Toluene diisocyanate (TDI) | — | — | 48.6 grams |
| Desmodur RF (DRF) | — | — | 21.8 grams |
| Magnetite (Pfizer MO-8029) | 300.0 grams | 300.0 grams | 318.2 grams |
| Dichloromethane | 20.0 milliliters | 20.0 milliliters | — |
| 1,4-bis(3-amino-propyl) piperazine | 34.3 grams | — | — |
| Diethylenetriamine | — | 25.0 grams | 32.0 grams |
| Water | 80.0 milliliters | 80.0 milliliters | 80.0 milliliters |
| Polyvinylalcohol | 0.55 gram | 0.50 gram | 0.50 gram |
| Water | 1.0 | 1.0 | 1.0 |

-continued

| | EXAMPLE V | EXAMPLE VI | EXAMPLE VII |
|---|---|---|---|
| | liter | liter | liter |

These encapsulated toner compositions were prepared by repeating the procedure of Example I with several exceptions. PAPI 27 was replaced with a lower viscosity polymethylene polyphenol isocyanate, PAPI 94, in both Examples V and VI, and toluene diisocyanate (TDI) and Desmodur RF (DRF) in Example VII; dichloromethane was employed as a viscosity reducer during the dispersion of magnetic iron oxide in Examples V and VI; and diethylenetriamine was replaced with 1,4-bis(3-aminopropyl)piperazine in Example V.

The results as outlined in Table 1 indicated that PAPI 94 provided a more durable shell structure compared with that of the TDI-DRF combination of Example VII. While it is not desired to be limited by theory, it is believed that the strength of the capsule shell for the toner compositions of the present invention is controlled by the functionality of the isocyanate selected. When PAPI 94 (crosslinking functionality 2.3) was selected as in Examples V and VI, no premature toner rupture was observed. The toner obtained from Example VII had a much less durable capsule shell resulting in severe premature toner rupture.

Excapsulated toner compositions were then prepared as follows to primarily demonstrate the effect of fixing pressure on print fix level, as well as the effect of toner shell composition on the fix level at lower fixing pressure.

EXAMPLE VIII

The procedure of Example VII was repeated with the exception that the amount of poly(vinylalcohol) was increased to 0.9 gram to obtain an encapsulated toner with an average particle size diameter of 17 microns.

EXAMPLE IX

An encapsulated toner composition was prepared by repeating the procedure of Example III with the exception that 0.8 gram of poly(vinylalcohol) was used to obtain a 17 micron average particle size diameter toner.

Toner samples obtained from both Examples VIII and IX were then tested in the S-6000 with a low fixing pressure of 100 pounds per linear inch. The composition of Example IX provided with this low fixing pressure a high final fix level of 86 percent. The compositions of Example VIII evidenced a poor initial fix level of 22 percent, and a final fix level of 50 percent. In addition, the composition of Example VIII evidenced severe premature toner rupture in the S-6000 development housing, whereas the composition of Example IX evidenced only very minor premature toner rupture in the S-6000 development housing.

EXAMPLE X AND XI

Two encapsulated toner compositions were prepared by repeating the procedure of Example I to primarily illustrate the effect of the toner core polymer molecular weight on fixability, and the tendency for premature toner rupture.

-continued

| | EXAMPLE X | EXAMPLE XI |
|---|---|---|
| Rocryl 320 (lauryl methacrylate) | 118.6 grams | 120.2 grams |
| Vazo 64 | 2.10 grams | 1.32 grams |
| Vazo 52 | 2.10 grams | 1.32 grams |
| Isonate 143L | 45.6 grams | 45.6 grams |
| Magnetic iron oxide (Pfizer MO-8029) | 300.0 grams | 300.0 grams |
| Dichloromethane | 20.0 milliliters | 20.0 milliliters |
| 1,4-bis(3-aminopropyl) piperazine | 32.0 grams | 32.0 grams |
| Water | 80.0 milliliters | 80.0 milliliters |
| Polyvinylalcohol | 0.50 gram | 0.50 gram |
| Water | 1.0 liter | 1.0 liter |

Although toner samples obtained from Examples III, X and XI have the same shell and core polymers, they differ only in core polymer molecular weight (see Table 1) due to the amount of polymerization initiators employed. Also, as outlined in Table 1, the toners of these Examples evidenced that the higher the value of the number average molecular weight ($M_n$), the lower the initial fix level, although the value of the final fix level is only changed slightly for this range of core polymer molecular weights. The composition of Example XI shows no premature toner rupture in the S-6000 development subsystem, and in addition exhibits a very high final fix level of 95 percent.

EXAMPLE XII

An encapsulated composition was prepared to primarily further demonstrate the advantages of the preferred shell materials of the present invention.

An encapsulated toner composition was prepared by repeating the procedure of Example VII with toluene diisocyanate, Desmodur RF, and triethylenediamine as the shell components with the exception that the amount of initiators was reduced in comparison to Example VII to increase the molecular weight ($M_n$), see Table 1, of the core polymer poly(lauryl methacrylate) to allow a direct comparison with Example XI.

| | EXAMPLE XII |
|---|---|
| Rocryl 320 (lauryl methacrylate) | 123.0 grams |
| Vazo 64 | 1.33 grams |
| Vazo 52 | 1.33 grams |
| Toluene diisocyanate (TDI) | 48.6 grams |
| Desmodur RF (DRF) | 21.8 grams |
| Magnetite (Pfizer MO-8029) | 318.2 grams |
| Diethylenetriamine | 32.0 grams |
| Water | 80.0 milliliters |
| Polyvinylalcohol | 0.50 grams |
| Water | 1.0 liter |

The results of print tests, shown in Table 1, clearly indicate that the composition of Example XII suffered from severe premature toner rupture and exhibited poor image fix to paper when compared to the composition of Example XI with the preferred shell which exhibits no premature toner rupture, and in addition evidences high image fix to paper.

EXAMPLE XIII

For purposes of another comparison, a nonencapsulated single component development cold pressure fixable toner was prepared by a melt blending method. This toner consisted of an intimate blend of magnetite, 60 weight percent, a low molecular weight polyethylene, 25 weight percent, a copolymer of ethylene and vinyl acetate, 10 weight percent, and as a minor component, 5 percent of a polyamide. The blend was micronized and classified to yield a toner with an average diameter of 23 microns. This toner was subsequently treated with carbon black (2.0 weight percent) and zinc stearate (0.5 weight percent) according to the procedure of Example II, yielding a toner with a resistivity of $3\times10^5$ ohm-cm. Many Examples of this invention evidenced a much superior final fix level and very low gloss images when compared to the 35 percent final fix level of the highly glossy images of the Example XIII toner, see Table 1.

| Example | Core | Shell Material 1st component | Shell Material 2nd component | Size μm | Aquadag E Treatment | Resist. ohm-cm | Fix Init. | Fix Final | Fixing Press. lbs. per linear inch | Mn | O.D. (f) | Shell Mechanical Strength (e) |
|---|---|---|---|---|---|---|---|---|---|---|---|---|
| I | LMA (a) 25 parts | PAPI 27 11 parts | DETA (b) 4 parts | 23 | yes | $6\times10^5$ stable | 30 | 64 | 200 | 32,000 | 1.50 | A |
| II | LMA 25 parts | PAPI 27 11 parts | DETA 4 parts | 24 | no | $9\times10^5$ un-stable | 25 | 62 | 200 | 32,000 | 1.52 | A |
| III | LMA 24 parts | Isonate 143L 9 parts | BAPP (c) 7 parts | 24 | yes | $6\times10^5$ stable | 78 | 99 | 200 | 31,000 | 1.48 | B |
| IV | LMA 24 parts | Isonate 143L 11 parts | HMDA (d) 5 parts | 23 | yes | $5\times10^5$ stable | 28 | 89 | 200 | 32,000 | 1.50 | B |
| V | LMA 24 parts | PAPI 94 9 parts | BAPP 7 parts | 23 | yes | $4\times10^5$ stable | 38 | 77 | 200 | 31,000 | 1.48 | A |
| VI | LMA 24 parts | PAPI 94 11 parts | DETA 5 parts | 23 | yes | $4\times10^5$ stable | 20 | 67 | 200 | 33,000 | 1.48 | A |
| VII | LMA 24 parts | TDI & DRF 10 parts (g) (h) | DETA 6 parts | 23 | yes | $2\times10^5$ stable | 30 | 68 | 200 | 36,000 | 1.52 | C |
| VIII | LMA 24 parts | TDI & DRF 10 parts | DETA 6 parts | 17 | yes | $3\times10^5$ stable | 22 | 50 | 100 | 32,000 | 1.48 | C |
| IX | LMA 24 parts | Isonate 143L 9 parts | BAPP 7 parts | 17 | yes | $2\times10^5$ stable | 32 | 86 | 100 | 31,000 | 1.49 | B |
| X | LMA 24 parts | Isonate 143L 9 parts | BAPP 7 parts | 23 | yes | $2\times10^5$ stable | 45 | 96 | 200 | 38,000 | 1.49 | B |
| XI | LMA 24 parts | Isonate 143L 9 parts | BAPP 7 parts | 22 | yes | $2\times10^5$ stable | 35 | 95 | 200 | 40,000 | 1.49 | A |
| XII | LMA 24 parts | TDI & DRF 10 parts | DETA 6 parts | 23 | yes | $4\times10^5$ stable | 23 | 60 | 200 | 40,000 | 1.50 | C |
| XIII | Melt blended SCD/CPF (i) Toner | No Shell | No Shell | 23 | — | $3\times10^5$ un-stable | 35 | 35 | 200 | — | 1.51 | — |

(a) Poly(lauryl methacrylate)
(b) Diethylene triamine, 99% grade
(c) 1,4-bis (3-aminopropyl) piperazine
(d) 1,6-hexane diamine
(e) A - no premature toner rupture B - very minor premature toner rupture C - severe premature toner rupture
(f) Optical density
(g) Toluene diisocyanate (TDI)
(h) Desmodur RF (DRF) (p-isocyanato-phenyl)-thiophosphate
(i) Single component development/cold pressure fixable Other modifications of the present invention may occur to those skilled in the art based upon a reading of the present disclosure, and these modifications are intended to be included within the scope of the present invention.

What is claimed is:

1. A cold pressure fixing toner composition comprised of a core containing a polymer component and magnetic pigment particles, and wherein the core is encapsulated within a shell comprised of the interfacial polycondensation reaction product of a first polyisocyanate component and a second amine component, which toner includes thereon an electroconductive material obtained from a water based dispersion of said material in a polymeric binder, said first polyisocyanate component being selected from the group consisting of polymethylene polyphenyl isocyanates, diphenylmethane diisocyanates, toluene diisocyanate, and tris(p-isocyanato-phenyl)-thiophosphate; and said second amine component selected from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)triamine, tris(2-aminoethyl)amine, 4,4'-methylene bis(cyclohexylamine), bis(3-aminopropyl)ethylene diamine, 1,3-bis(aminomethyl)-cyclohexane, 1,5-diamino-2-methylpentane, piperazine, 2-methylpiperazine, 2,5-dimethylpiperazine, and 1,4-bis(3-aminopropyl)piperazine.

2. A toner composition in accordance with claim 1 wherein core polymer component is selected from the group consisting of acrylates and methacrylates.

3. A toner composition in accordance with claim 1 wherein core polymer component is selected from the group consisting of poly(lauryl methacrylate), poly(-dodecyl acrylate), poly(stearyl methacrylate), styrene-lauryl methacrylate copolymer, and poly(dodecyl styrene).

4. A toner composition in accordance with claim 1 wherein the magnetic particles are magnetite.

5. A toner composition in accordance with claim 1 wherein the core polymer is poly(lauryl methacrylate); and the first shell monomer is a liquid diphenylmethane diisocyanate which reacts with the second shell amine monomer 1,4-bis(3-aminopropyl)piperazine to form a partially crosslinked polyurea.

6. A toner composition in accordance with claim 1 wherein the core polymer is poly(lauryl methacrylate); and the first shell monomer is a polymethylene polyphenyl isocyanate with a weight average molecular weight of from about 260 to about 300, which reacts with the second amine shell momomer 1,4-bis(3-aminopropyl)piperazine to form a partially crosslinked polyurea.

7. A toner composition in accordance with claim 1 wherein the electroconductive material is a colloidal graphite.

8. A toner composition in accordance with claim 1 wherein the resistivity of the toner is from about $1\times10^3$ to about $1\times10^8$ ohm-cm.

9. A toner composition in accordance with claim 1 wherein the core polymer has a number average molecular weight of from about 15,000 to about 100,000.

10. A toner composition in accordance with claim 1 wherein the core polymer has a number average molecular weight of from about 25,000 to about 60,000.

11. A toner composition in accordance with claim 1 wherein the weight average molecular weight number average molecular weight ratio is greater than 2.

12. A toner composition in accordance with claim 1 wherein the weight average number average molecular weight ratio is from about 2.5 to about 4.

13. A cold pressure fixable toner composition comprised of a core comprising a polymer component selected from the group consisting of poly(lauryl methacrylate), poly(dodecyl acrylate), poly(stearyl methacrylate), styrene-lauryl methacrylate copolymer and poly(-dodecyl styrene), and magnetic pigment particles, which core is encapsulated within a shell comprised of the interfacial polycondensation reaction product of a first component selected from the group consisting of polymethylene polyphenyl isocyanates, diphenylmethane diisocyanates, toluene diisocyanate, and tris(p-isocyanato-phenyl)-thiophosphate; and a second component selected from the group consisting of ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)triamine, tris(2-aminoethyl)amine, 4,4'-methylene bis(cyclohexylamine), bis(3-aminopropyl)ethylene diamine, 1,3-bis(aminomethyl)-cyclohexane, 1,5-diamino-2-methylpentane, piperazine, 2-methylpiperazine, 2,5-dimethylpiperazine, and 1,4-bis(3-aminopropyl)piperazine; and wherein said toner composition includes thereon an electroconductive component obtained from a water based dispersion of said component in a polymeric binder.

14. A toner composition in accordance with claim 13 wherein the electroconductive component is a colloidal graphite.

15. A toner composition in accordance with claim 13 with a resistivity of from about $1\times10^3$ to about $1\times10^8$ ohm-cm.

16. A toner composition in accordance with claim 13 wherein the core polymer possesses a glass transition temperature of from about −170° C. to +25° C.

17. A toner composition in accordance with claim 13 wherein the core polymer possesses a glass transition temperature of from about −80° C. to about −10° C.

18. A toner composition in accordance with claim 13 wherein the core polymer has a number average molecular weight of from about 15,000 to about 100,000.

19. A toner composition in accordance with claim 13 wherein the core polymer components is poly(lauryl methacrylate) having a number average molecular weight of from about 25,000 to about 60,000.

20. A toner composition in accordance with claim 13 wherein the core polymer has a ratio of $M_w/M_n$ of from about 2.5 to about 4.

21. A toner composition in accordance with claim 13 wherein the magnetic material is selected from the group of metals, and metal oxides.

22. A toner composition in accordance with claim 21 wherein the magnetic material is selected from the group consisting of iron, cobalt, nickel, manganese, and alloys thereof.

23. A toner composition in accordance with claim 13 wherein the magnetic material is magnetite.

24. A toner composition in accordance with claim 13 wherein the magnetic material comprises from between about 30 to 65 percent of the toner; the core polymer component comprises from between about 10 to about 64 percent of the toner; and the shell materials comprise from between about 6 to about 25 percent of the toner.

25. A toner composition in accordance with claim 13 wherein the magnetic material comprises from between about 50 to 60 percent of the toner; the core polymer component comprises from between about 22 to about 38 l percent of the toner; and the shell materials comprise from between about 12 to about 18 percent of the toner.

26. A toner composition in accordance with claim 13 wherein the core polymer is poly(lauryl methacrylate); and the first shell monomer is diphenylmethane diisocyanate, which reacts with the second shell monomer 1,4-bis(3-aminopropyl)piperazine to form a partially crosslinked polyurea.

27. A toner composition in accordance with claim 13 wherein the core polymer is poly(lauryl methacrylate); and the first shell monomer is a polymethylene polyphenyl isocyanate, which reacts with the second shell monomer 1,4-bis(3-aminopropyl)piperazine to form a partially crosslinked polyurea.

28. A toner composition in accordance with claim 27 wherein the isocyanate has an average molecular weight of from about 260 to about 300 and an average functionality of about 2.3.

29. A toner composition in accordance with claim 13 wherein the resistivity of the toner is from about $5\times10^4$ to about $1\times10^7$ ohm-cm.

30. A toner composition in accordance with claim 13 wherein the electroconductive material is selected from the group consisting of carbon black dispersed in a polymeric binder, and graphite dispersed in a polymeric binder in the amount of about 0.5 to 2.0 percent by weight of the toner.

31. A toner composition in accordance with claim 13 prepared by a process which comprises mixing in the presence or absence of a solvent, core monomers, polymerization initiators for the aforementioned core monomers, pigment particles, and said first shell component; thereafter dispersing the resulting mixed organic phase into a solution of a stabilizer in water, forming a stabilized dispersion of pigmented particles; subsequently adding the said second shell component to the aqueous dispersion thereby forming a polymeric shell comprised of the first and second shell component; thereafter accomplishing a free radical polymerization of the core monomer, and subsequently adding thereto an electroconductive material obtained from a water based dispersion of said material in a polymeric binder.

32. A toner composition in accordance with claim 1 containing external additives selected from the group consisting of metal salts and metal salts of fatty acids.

33. A toner composition in accordance with claim 13 containing external additives selected from the group consisting of metal salts and metal salts of fatty acids.

34. A toner composition in accordance with claim 31 wherein the additive is zinc stearate.

35. A toner composition in accordance with claim 32 wherein the additive is zinc stearate.

36. A method of imaging which comprises forming by ion deposition on an electroreceptor a latent image; subsequently developing this image with the toner composition of claim 1; and thereafter simultaneously transferring and fixing the image to a suitable substrate.

37. A method of imaging which comprises forming by ion deposition on an electroreceptor a latent image; subsequently developing this image with a toner composition of claim 13, and thereafter simultaneously transferring and fixing the image to a suitable substrate.

38. A method of imaging in accordance with claim 36 wherein fixing is accomplished at pressures of from about 80 to 250 pounds per linear inch.

39. A toner composition in accordance with claim 13 wherein the surface of the toner contains thereon additives selected from the group consisting of fumed silicas and colloidal silicas.

40. A toner composition in accordance with claim 13 wherein the additive is a release component present in the amount of from about 0.5 to 3.0 percent by weight.

41. A toner composition in accordance with claim 40 wherein the release component is selected from the group consisting of zinc stearate and magnesium stearate.

* * * * *

UNITED STATES PATENT AND TRADEMARK OFFICE

CERTIFICATE OF CORRECTION

PATENT NO. : 4,877,706

DATED : October 31, 1989

INVENTOR(S) : Hadi K. Mahabadi et al.

It is certified that error appears in the above--identified patent and that said Letters Patent is hereby corrected as shown below:

Claim 25, line 5, after "38", delete "I".

Claim 31, line 1, delete "in accordance with claim 13".

Signed and Sealed this

Thirtieth Day of October, 1990

*Attest:*

HARRY F. MANBECK, JR.

*Attesting Officer*

*Commissioner of Patents and Trademarks*